US008397606B2

(12) United States Patent
Hu

(10) Patent No.: US 8,397,606 B2
(45) Date of Patent: Mar. 19, 2013

(54) RATCHET WRENCH WITH A REDUCED HEAD

(76) Inventor: Bobby Hu, Taichung (TW)

( * ) Notice: Subject to any disclaimer, the term of this patent is extended or adjusted under 35 U.S.C. 154(b) by 145 days.

(21) Appl. No.: 13/039,421

(22) Filed: Mar. 3, 2011

(65) Prior Publication Data

US 2012/0180603 A1 Jul. 19, 2012

(30) Foreign Application Priority Data

Jan. 14, 2011 (TW) ..... 100101499 A

(51) Int. Cl.
*B25B 13/46* (2006.01)

(52) U.S. Cl. ..... 81/62; 81/63.1

(58) Field of Classification Search ..... 81/58–63.2, 81/177.1, 489, 436–439
See application file for complete search history.

(56) References Cited

U.S. PATENT DOCUMENTS 6,644,148 B2 * 11/2003 Hu ..... 81/63.2
7,093,520 B2 8/2006 Tuanmu ..... 81/63.1
2008/0223180 A1 * 9/2008 Huang ..... 81/63.2

* cited by examiner

*Primary Examiner* — Monica Carter
*Assistant Examiner* — Melanie Alexander
(74) *Attorney, Agent, or Firm* — Alan Kamrath; Kamrath IP Lawfirm, P.A.

(57) ABSTRACT

A ratchet wrench includes a connecting section between a head and a handle. The connecting section includes a vertical connecting portion integrally connected to a first side of the head. An extension extends outward from a section of an outer periphery of the head. A first compartment extends from the first side of the head through a second side of the head and rotatably receives a drive member. A second compartment is formed in a portion of the inner periphery of the first compartment aligned with the extension and receives two pawls releasably engaged with the drive member. The second compartment extends towards the extension. A first radius from the outer periphery of the head to a rotating axis defined by the head is smaller than a second radius from the extension to the rotating axis.

19 Claims, 15 Drawing Sheets

RATCHET WRENCH WITH A REDUCED HEAD

BACKGROUND OF THE INVENTION

The present invention relates to a ratchet wrench with a reduced head and, more particularly, to a ratchet wrench having a head that can be moved into a small, recessed environment for operation.

U.S. Pat. Ser. No. 7,093,520 discloses a gear wrench having a head formed with a receiving compartment for receiving a gear ring, a tail, and a neck between the head and the tail. The neck extends obliquely from the head towards the tail to form a height difference between the head and the tail. An indent and an aperture are provided between the neck and the head for mounting a direction switch. The indent allows access of the fingers of the user to the direction switch, such that the user can rotate the direction switch to change the driving direction of the ratchet wrench. In use, the obliquely extending neck allows the ratchet wrench to tighten or loosen a workpiece, such as a fastener, in a recessed environment. The maximal diameter of the head must be smaller than the space of the recessed environment. However, the head of the ratchet wrench can not enter the space if there are obstacles in the space. A solution to this problem is using an extension rod or extension socket to increase the working depth of the ratchet wrench to access the workpiece in the space. However, coupling of the extension rod or extension socket of a suitable length is troublesome and time-consuming. The weight of the extension rods or extension sockets cause a burden to the user in addition to troublesome handling and selection of the extension rod or extension socket of the desired size. Thus, the ratchet wrench of this type still has disadvantages.

Thus, a need exists for a novel ratchet wrench without the above disadvantages.

BRIEF SUMMARY OF THE INVENTION

The present invention solves this need and other problems in the field of convenient use of ratchet wrenches in a small space by providing, in a preferred aspect, a ratchet wrench including a body having a head, a handle, and a connecting section between the head and the handle. The head defines a rotating axis. The head is adapted to drive a workpiece to rotate. The head includes first and second sides spaced along the rotating axis. The first side has a spacing to the workpiece larger than the second side. The head further includes an outer periphery extending between the first and second sides and surrounding the rotating axis. The outer periphery includes an arcuate section. An extension extends outward from a section of the outer periphery outside of the arcuate section in a radial direction perpendicular to the rotating axis. The head further includes a first compartment extending from the first side through the second side of the head along the rotating axis. The first compartment has circular cross sections and includes an inner periphery. A second compartment is formed in a portion of the inner periphery of the first compartment aligned with the extension. The second compartment extends towards the extension. The connecting section includes a vertical connecting portion at an end thereof. The vertical connecting portion is integrally connected to the first side of the head. The other end of the connecting section is integrally connected to an end of the handle. A drive member is rotatably received in the first compartment of the head and is rotatable relative to the head about the rotating axis. A pawl device is mounted in the second compartment of the body. The pawl device is selectively engageable with the drive member in either of first and second engagement relations corresponding to two driving directions of the ratchet wrench driving the workpiece. A switch is pivotably mounted to the drive member and operatively connected to the pawl device in the second compartment. The switch includes a ring exposed outside of the first side of the head for manual operation to control the pawl device to be in one of the first and second engagement relations with the drive member.

Preferably, a positioning device is mounted between the switch and the vertical connecting portion of the connecting section. The ring includes first and second positioning portions. The positioning device is engaged with one of the first and second positioning portions to retain the ring, maintaining the pawl device in one of the first and second engagement relations with the drive member.

Preferably, the vertical connecting portion includes a receptacle extending in a radial direction perpendicular to the rotating axis. The positioning device includes an elastic element received in the receptacle and a positioning member between the elastic element and the switch. The positioning member is biased by the elastic element to engage with one of the first and second positioning portions.

Preferably, the drive member includes first and second ends spaced along the rotating axis. An axle is formed on the first end of the drive member. The switch includes an axle hole receiving the axle. The switch and the drive member are pivotable relative to each other.

Preferably, the axle extends beyond the first side of the head. The axle includes an annular engagement groove. The axle hole of the switch includes an annular engagement groove. A retainer ring is engaged in the engagement grooves of the axle and the switch, preventing disengagement of the switch while allowing relative rotating movement between the switch and the drive member. The drive member includes a stepped portion on an outer periphery thereof. The stepped portion has an outer diameter larger than a diameter of the first compartment.

Preferably, the drive member includes an annular toothed portion between the first and second ends of the drive member. The toothed portion of the drive member is received in the first compartment of the body. The pawl device includes first and second pawls and an elastic element mounted between the first and second pawls. The elastic element biases the first and second pawls to press against two lateral walls of the second compartment. The first pawl includes a first toothed section facing the first compartment. The first toothed section is engageable with the toothed portion of the drive member under bias of the elastic element. The second pawl includes a second toothed section facing the first compartment. The second toothed section is engageable with the toothed portion of the drive member under the bias of the elastic element.

Preferably, the first pawl includes a first push face. The second pawl includes a second push face. The switch includes first and second actuating portions extending into the second compartment. The switch is pivotable in a first direction to cause the first actuating portion to press against the first push face, disengaging the first toothed section from the toothed portion of the drive member. On the other hand, the switch is pivotable in a second direction opposite to the first direction to cause the second actuating portion to press against the second push face, disengaging the second toothed section from the toothed portion of the drive member.

Preferably, the ring includes a lip extending perpendicularly from an inner face of the ring. The lip includes the first and second actuating portions. A notch is formed between the first and second actuating portions.

Preferably, the ring includes a third positioning portion between the first and second portions. When the first and second pawls are located in the notch, the first and second toothed sections of the first and second pawls are engaged with toothed portion of the drive member, and the positioning device is engaged with the third positioning portion, preventing the drive member from rotating relative to the head.

Preferably, the axle of the drive member has an outer diameter smaller than a diameter of the first compartment. The first and second actuating portions of the switch extend through the first compartment into the second compartment.

In an embodiment, the head further includes a control groove extending from the first side through the second compartment. The first and second actuating portions of the switch extend through the control groove into the second compartment. Preferably, the control groove is in communication with the first compartment. The control groove has a longitudinal axis coincident to the rotating axis. The control groove is annular, extends between the first side of the head and the first compartment and forms a ledge. The switch is hollow, and the first and second actuating portions are arcuate and movable in the control groove in a circumferential direction about the rotating axis.

The head includes a thickness between the first and second sides along the rotating axis. The vertical connecting portion includes a height along the rotating axis smaller than the thickness of the head. Preferably, the axle of the drive member has a protruding extent beyond the first side of the head along the rotating axis. The protruding extent is not larger than the height of the vertical connecting portion. The ring has an exposed extent outside of the first side of the head. The exposed extent is not larger than the height of the vertical connecting portion.

Preferably, the exposed extent of the ring is equal to the protruding extent of the axle.

Preferably, the exposed extent of the ring is equal to the height of the vertical connecting portion.

Preferably, the handle includes upper and lower faces. The upper face has a spacing to the workpiece larger than the lower face. In an embodiment, a spacing between the lower face of the handle and the second side of the head is larger than half of the thickness of the head. A spacing between the upper face of the handle and the first side of the head is larger than the height of the vertical connecting portion and smaller than the thickness of the head. Preferably, the spacing between the upper face of the handle and the first side of the head is equal to the height of the vertical connecting portion.

In another embodiment, the spacing between the lower face of the handle and the second side of the head is larger than a sum of the height of the vertical connecting portion and the thickness of the head.

Preferably, the other end of the connecting section opposite to the vertical connecting portion includes a bend integrally connected to the end of the handle. The connecting section has an inclined section intermediate the vertical connecting portion and the bend. The inclined section has increasing widths towards the vertical connecting portion and is at an angle of 75° to the handle.

Preferably, the head has a first radius from the outer periphery to the rotating axis. The head further has a second radius from the extension to the rotating axis. The first radius is smaller than the second radius. The vertical connecting portion includes an arcuate concave face facing the rotating axis. The arcuate concave face has a third radius to the rotating axis. The third radius is equal to the first radius.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
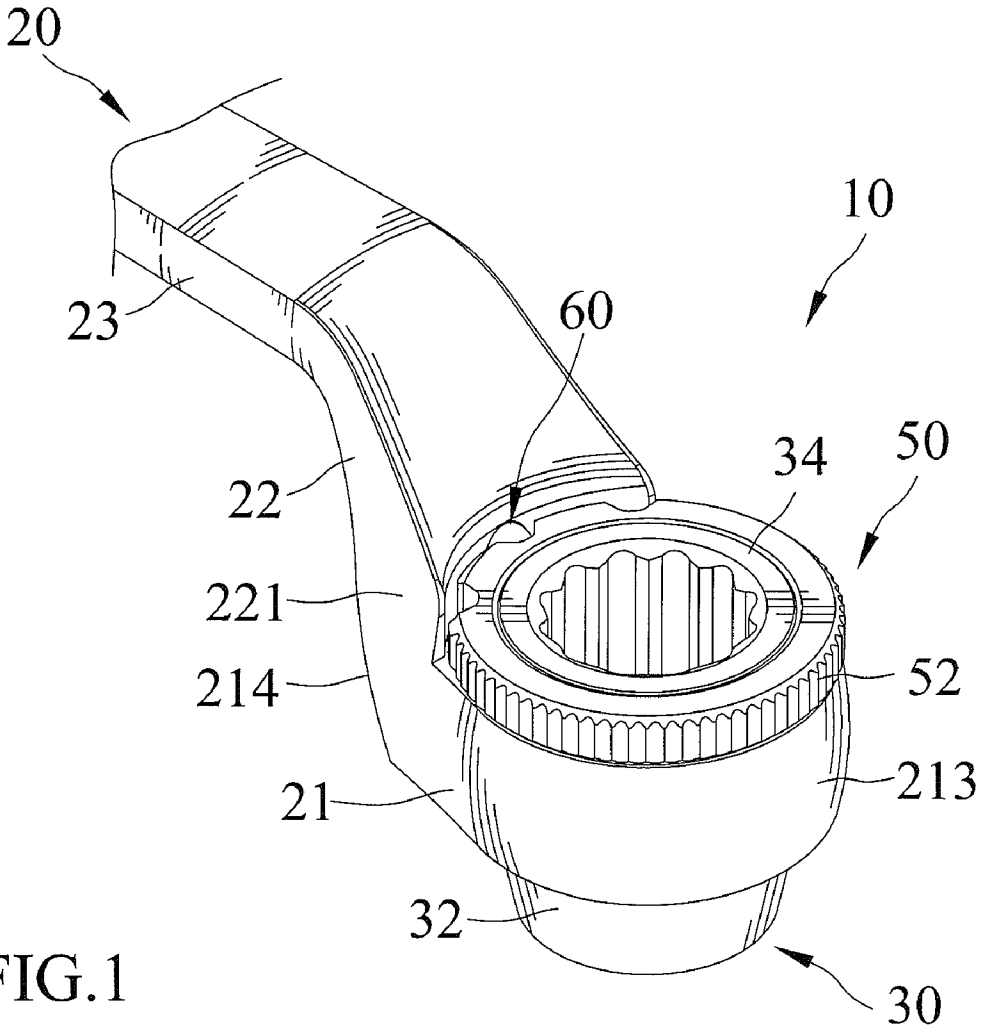
FIG. 1 shows a partial, perspective view of a ratchet wrench according to a first embodiment according to the present invention.
Figure 2:
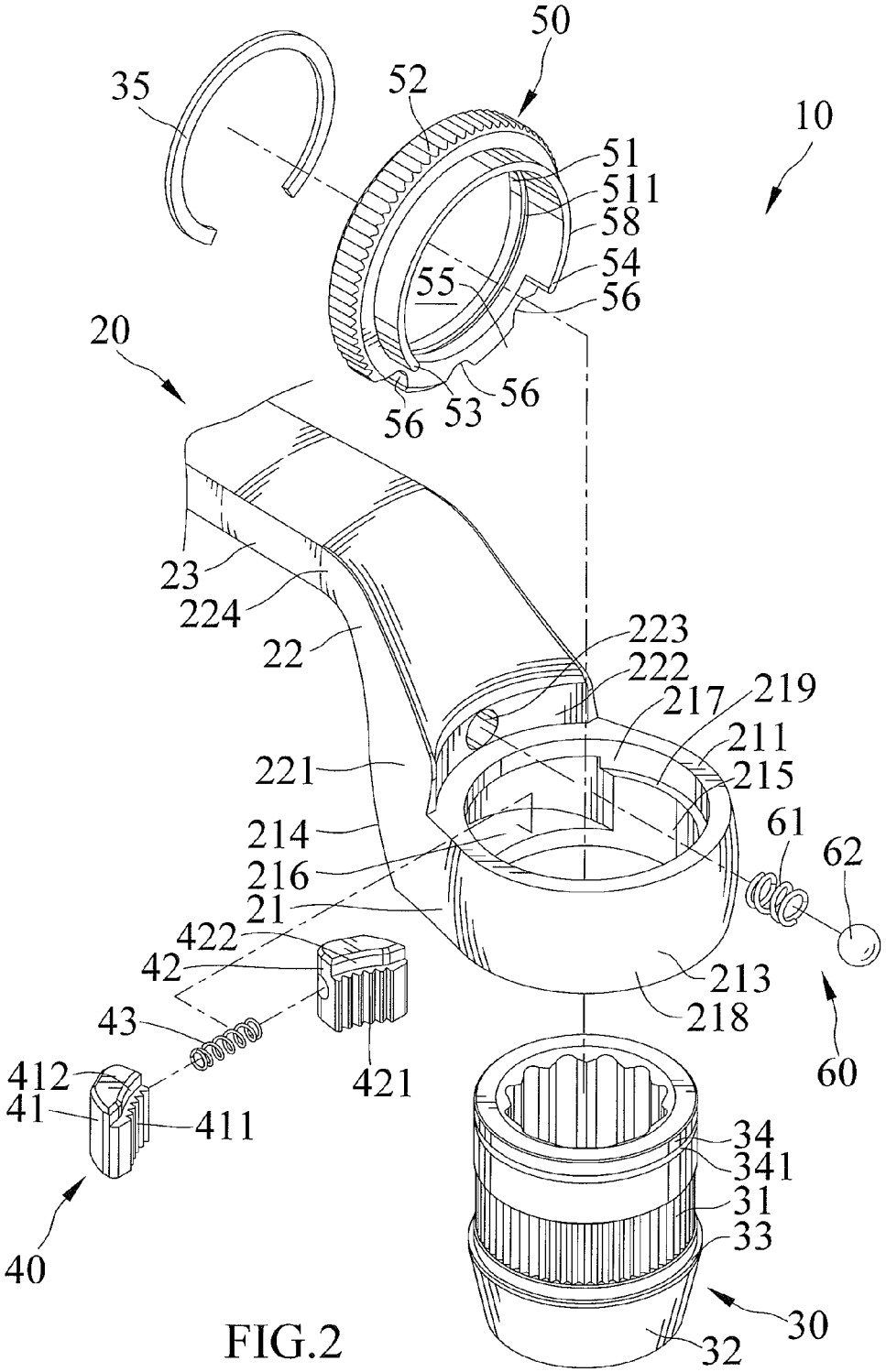
FIG. 2 shows a partial, exploded, perspective view of the ratchet wrench of FIG. 1.
Figure 3:
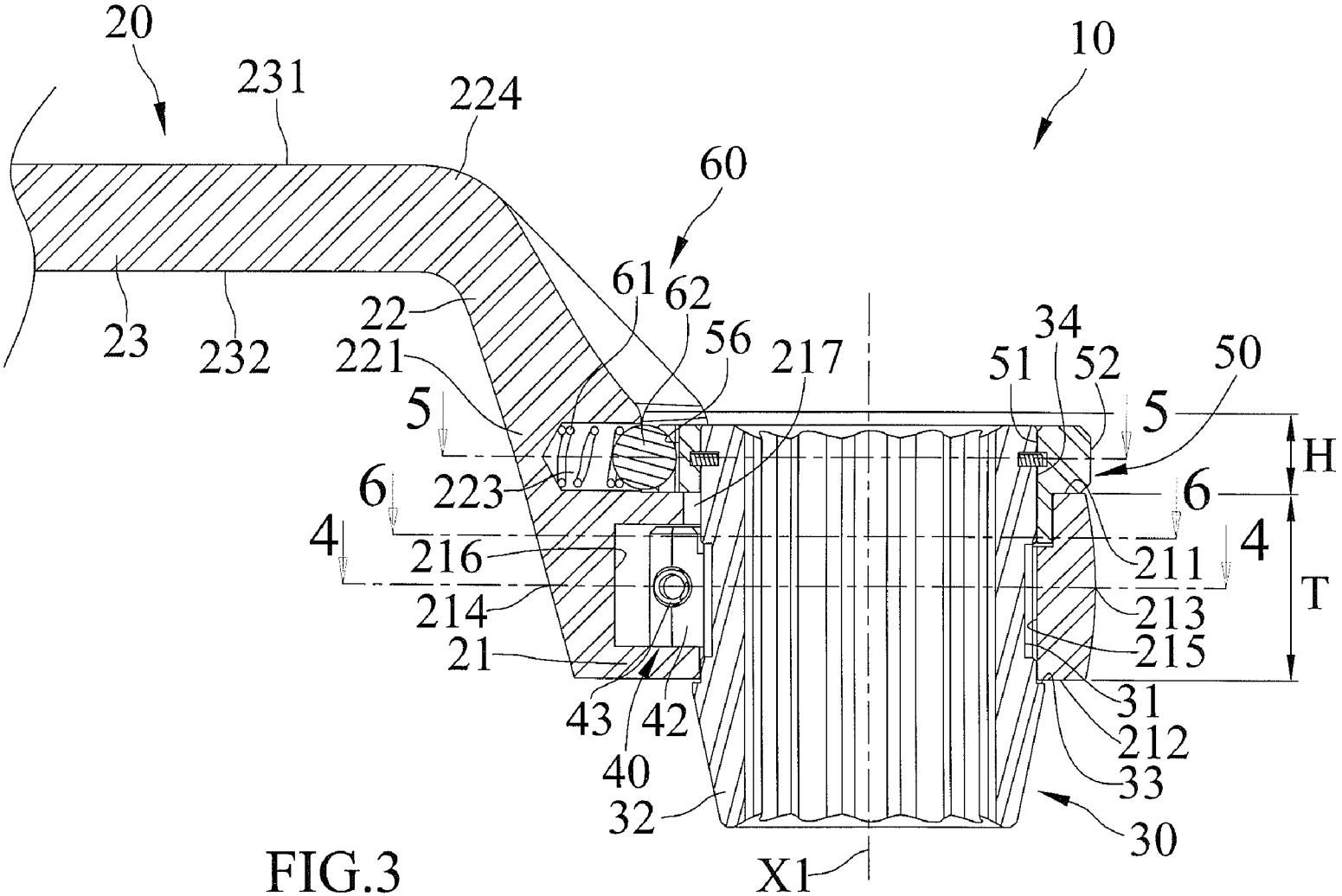
FIG. 3 shows a cross sectional view of the ratchet wrench of FIG. 1.
Figure 4:
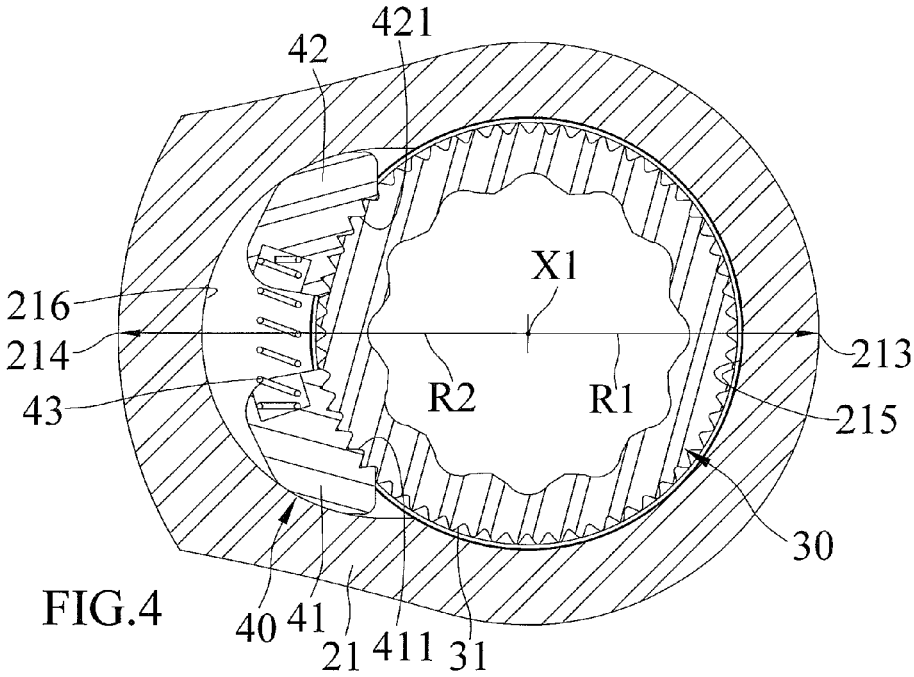
FIG. 4 shows a cross sectional view taken along section line 4-4 of FIG. 3.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "top", "inner", "outer", "side", "end", "portion", "section", "longitudinal", "radial", "circumferential", "lateral", "horizontal", "vertical", "annular", "outward", "spacing", "clockwise", "thickness", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIGS. 1-4, a ratchet wrench 10 of a first embodiment according to the present invention includes a body 20, a drive member 30, a pawl device 40, and a switch 50. Body 20 includes a head 21, a handle 23, and a connecting section 22 between head 21 and handle 23. Head 21 defines a rotating axis X1. A user can operate body 20 by rotating handle 23 about rotating axis X1 for driving a workpiece, such as a fastener, to rotate. Head 21 includes parallel, first and second sides 211 and 212 spaced along rotating axis X1. First side 211 has a spacing to the workpiece larger than second side 212. Head 21 has a thickness T between first side 211 and second side 212 along rotating axis X1.

Head 21 further includes a control groove 217 extending from first side 211 through second compartment 216. In this embodiment, control groove 217 is in communication with first compartment 215 and has a longitudinal axis coincident to rotating axis X1. Control groove 217 is annular, extends between first side 211 of the head 21 and first compartment 215 and forms a ledge 219.

Head 21 further includes a first compartment 215 extending from first side 211 through second side 212 along rotating axis X1. First compartment 215 has circular cross sections. A second compartment 216 is formed in a portion of an inner periphery of first compartment 215 aligned with extension 214. Second compartment 216 extends towards extension 214 and is crescent in cross section.

Head 21 further includes a control groove 217 extending from first side 211 through second compartment 216. In this embodiment, control groove 217 is in communication with first compartment 215 and has a longitudinal axis coincident to rotating axis X1. Control groove 217 is annular and extends between first side 211 of the head 21 and first compartment 215 and forms a ledge 219.

Connecting section 22 includes a vertical connecting portion 221 at an end thereof. Vertical connecting portion 221 is integrally connected to first side 211 of head 21, such that head 21 has a small volume and occupies a small space. In this embodiment, vertical connecting portion 221 is integrally connected to a side of extension 214 opposite to second side 212 of head 21. Thus, second radius R2 of head 21 can be effectively reduced to reduce the size of head 21. Vertical connecting portion 221 includes a height H along rotating axis X1 smaller than thickness T of head 21.

Figure 5:
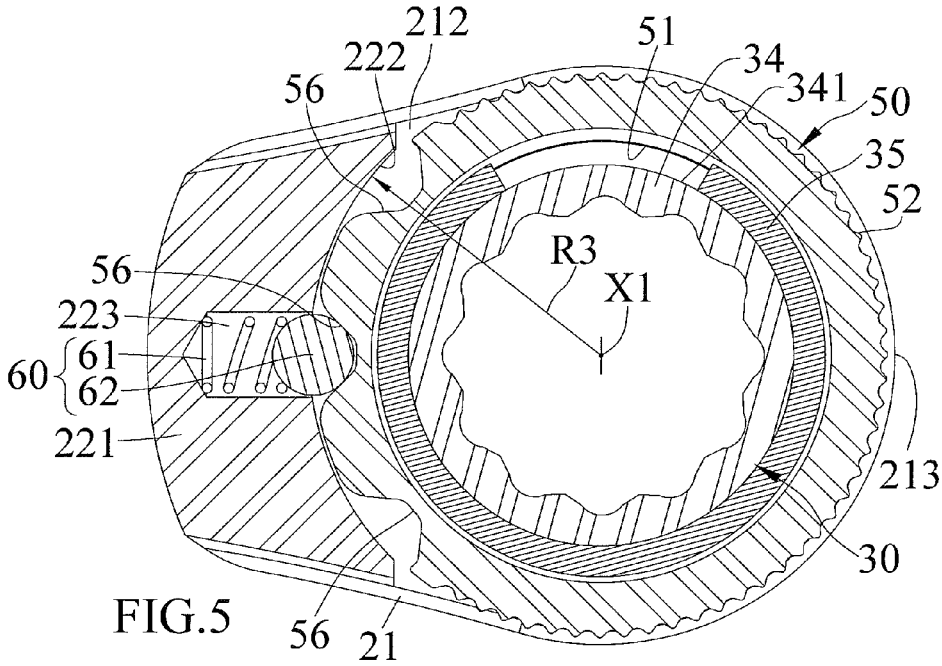
FIG. 5 shows a cross sectional view taken along section line 5-5 of FIG. 3.

Vertical connecting portion 221 includes an arcuate concave face 222 facing rotating axis X1. Arcuate concave face 222 of vertical connecting portion 221 includes a receptacle 223 extending in a radial direction perpendicular to rotating axis X1. Arcuate concave face 222 has a third radius R3 to rotating axis X1. Third radius R3 is equal to first radius R1 of outer periphery 213 of head 21, as shown in FIG. 5. Thus, second radius R2 of head 21 can be effectively reduced to reduce the size of head 21.

The other end of connecting section 22 opposite to vertical connecting portion 221 includes a bend 224 integrally connected to the end of handle 23. Connecting section 22 has an inclined section intermediate vertical connecting portion 221 and bend 224. The inclined section has increasing widths towards vertical connecting portion 221 and is at an angle of in the order of 75° to handle 23. Thus, connecting section 22 is substantially at 75° to head 21.

Handle 23 includes upper and lower faces 231 and 232. Upper face 231 has a spacing to the workpiece larger than lower face 232. A spacing between lower face 232 of handle 23 and second side 212 of head 21 is larger than a sum of height H of vertical connecting portion 221 and thickness T of head 21. This allows the small head 21 to extend into a small space for operation while the user grips handle 23.

Drive member 30 is rotatably received in first compartment 215 of head 21 and rotatable relative to head 21 about rotating axis X1. Drive member 30 includes an annular toothed portion 31 between first and second ends of drive member 30 spaced along rotating axis X1. A driving portion 32 is formed on the second end of drive member 30 for driving the workpiece to rotate. In this embodiment, driving portion 32 extends beyond second side 212 of head 21 and includes a polygonal hole and a conical outer periphery. A stepped portion 33 is formed between driving portion 32 and toothed portion 31 and has an outer diameter larger than a diameter of first compartment 215. Thus, stepped portion 33 can abut second side 212 of head 21. An axle 34 is formed on the first end of drive member 30 and extends beyond first side 211 of head 21. The protruding extent of axle 34 beyond first side 211 of head 21 along rotating axis X1 is not larger than height H of vertical connecting portion 221. Axle 34 includes an annular engagement groove 341.

Pawl device 40 is mounted in second compartment 216 of body 20 and is selectively engageable with drive member 30 in either of first, second, and third engagement relations. The first and second engagement relations correspond to two driving directions of ratchet wrench 10 driving the workpiece. Drive member 30 can not rotate relative to head 21 when pawl device 40 is in the third engagement relation with drive member 30.

Pawl device 40 includes first and second pawls 41 and 42 and an elastic element 43 mounted between first and second pawls 41 and 42. Elastic element 43 biases first and second pawls 41 and 42 to press against two lateral walls of second compartment 216. First pawl 41 includes a first toothed section 411 facing first compartment 215. First toothed section 411 is engageable with toothed portion 31 of drive member 30 under the bias of elastic element 43. First pawl 41 includes a first push face 412 corresponding to the position of control groove 217. Second pawl 42 includes a second toothed section 421 facing first compartment 215. Second toothed section 421 is engageable with toothed portion 31 of drive member 30 under the bias of elastic element 43. Second pawl 42 includes a second push face 422 corresponding to the position of control groove 217.

Switch 50 includes a ring 52 exposed outside of first side 211 of head 21 for manual operation. An outer periphery of ring 52 is aligned with outer periphery 213 of head 21. Thus, the user can easily rotate ring 52 from outside. In this embodiment, ring 52 has a diameter larger than the diameter of first compartment 215. Furthermore, a radius of ring 52 is smaller than first radius R1 of outer periphery 213 of head 21. Thus, when switch 50 is rotated relative to head 21, ring 52 still remains in the extent of first radius R1 of outer periphery 213 of head 21. Namely, switch 50 does not extend beyond first radius R1. Thus, connecting section 22 of body 20 can be adjacent to rotating axis X1 without being interfered by switch 50, effectively reducing the radius of head 21 and reliably reducing the size of head 21.

Switch 50 includes a ring 52 exposed outside of first side 211 of head 21 for manual operation. An outer periphery of ring 52 is aligned with outer periphery 213 of head 21. Thus, the user can easily rotate ring 52 from outside. In this embodiment, ring 52 has a diameter larger than the diameter of first compartment 215. Furthermore, a radius of ring 52 is smaller than first radius R1 of outer periphery 213 of head 21. Thus, when switch 50 is rotated relative to head 21, ring 52 still remains in the extent of first radius R1 of outer periphery 213 of head 21. Namely, switch 50 does not extend beyond first radius R1. Thus, connecting section 22 of body 20 can be more adjacent to rotating axis X1 without being interfered by switch 50, effectively reducing the radius of head 21 and reliably reducing the size of head 21.

Ring 52 has an exposed extent outside of first side 211 of head 21. The exposed extent of ring 52 is not larger than height H of vertical connecting portion 221 of body 20. Preferably, the exposed extent of ring 52 is equal to the protruding extent of axle 34 beyond first side 211 of head 21. Thus, a top face of ring 52 is flush with a top face of axle 34 of drive member 30. Thus, the top face of axle 34 is exposed and accessible to the user.

Figure 6:
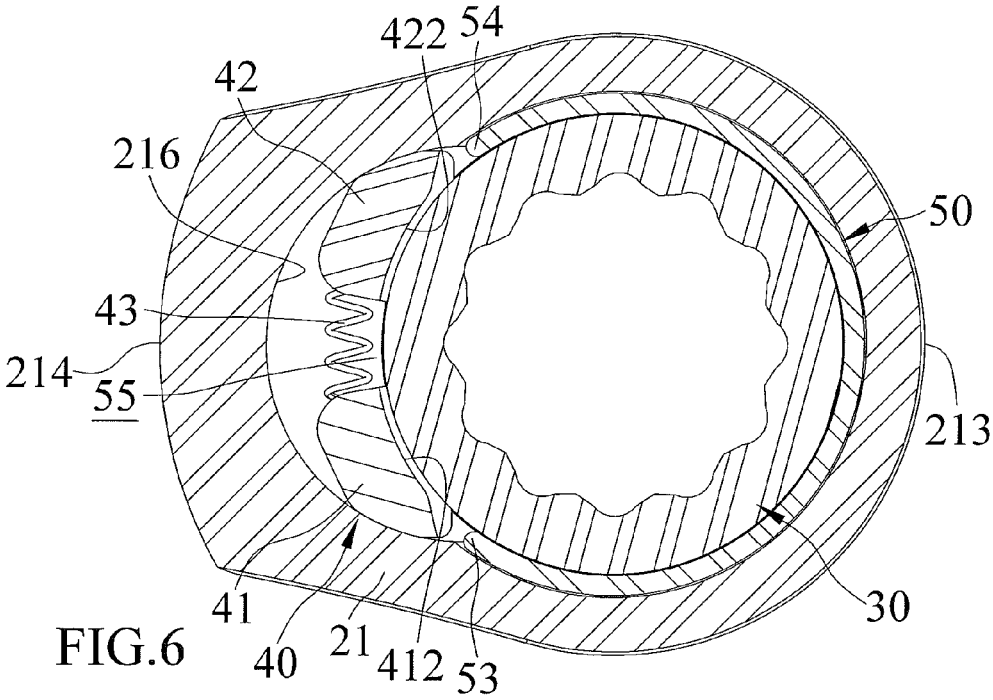
FIG. 6 shows a cross sectional view taken along section line 6-6 of FIG. 3.

Switch 50 includes first and second actuating portions 53 and 54 extending into second compartment 216. Switch 50 can be pivoted in a first direction to cause first actuating portion 53 to press against first push face 412, disengaging first toothed section 411 from toothed portion 31 of drive member 30, as shown in FIG. 6. Likewise, switch 50 can be pivoted in a second direction opposite to the first direction to cause second actuating portion 54 to press against second push face 422, disengaging second toothed section 421 from toothed portion 31 of drive member 30.

In this embodiment, first and second actuating portions 53 and 54 of switch 50 extend through control groove 217 into second compartment 216. First and second actuating portions 53 and 54 are arcuate and movable in control groove 217 in the circumferential direction about rotating axis X1. First actuating portion 53 has a thickness along rotating axis X1 larger than a height of first toothed section 411 of first pawl 41 along rotating axis X1. Thus, when first actuating portion 53 separates first pawl 41 from drive member 30, first pawl 41 disengages from drive member 30. Note that first pawl 41 presses against one of the two lateral walls of second compartment 216 under the bias of elastic element 43. Thus, first and second pawls 41 and 42 provide reliable ratcheting effect. Likewise, second actuating portion 54 has a thickness along rotating axis X1 larger than a height of second toothed section 421 of second pawl 42 along rotating axis X1. Thus, when second actuating portion 54 separates second pawl 42 from drive member 30, second pawl 42 disengages from drive member 30. Note that second pawl 42 presses against the other lateral wall of second compartment 216 under the bias of elastic element 43. Thus, first and second pawls 41 and 42 provide reliable ratcheting effect.

In this embodiment, ring 52 includes an outer periphery having first and second positioning portions 56 and a third positioning portion 56 between first and second portions 56. Ring 52 further includes a lip 58 extending perpendicularly from an inner face of ring 52 opposite to the top face of ring 52. Lip 58 includes first and second actuating portions 53 and 54. A notch 55 is formed between first and second actuating portions 53 and 54. First and second toothed sections 411 and 421 of first and second pawls 41 and 42 engage with toothed portion 31 of drive member 30 when first and second pawls 41 and 42 are located in notch 55, preventing drive member 30 from rotating relative to head 21.

A positioning device 60 is mounted between switch 50 and vertical connecting portion 221 of connecting section 22. When positioning device 60 is engaged with one of first and second positioning portions 56 and retains ring 52, pawl device 40 is in one of the first and second engagement relations with drive member 30, allowing rotation of drive member 30 relative to head 21 in one of two opposite directions corresponding to one of two driving directions of ratchet wrench 10. On the other hand, when positioning device 60 is engaged with third positioning portion 56 and retains ring 52, pawl device 40 is in the third engagement relation with drive member 30, allowing joint rotation of drive member 30 and head 21 in either direction.

Since positioning device 60 is mounted to vertical connecting portion 221 that is integrally connected to first side 211 of head 21, extension 214 of head 21 can be very short as long as the radial extent of extension 214 allows connecting section 22 to be close to drive member 30. The radial dimension of head 21 can, thus, be effectively reduced to reduce the size of head 21.

Positioning device 60 includes an elastic element 61 received in receptacle 223 and a positioning member 62 between elastic element 61 and switch 50. Positioning member 62 is biased by elastic element 61 to engage with one of first, second, and third positioning portions 56. In this embodiment, positioning member 62 is in the form of a ball.

Figure 8:
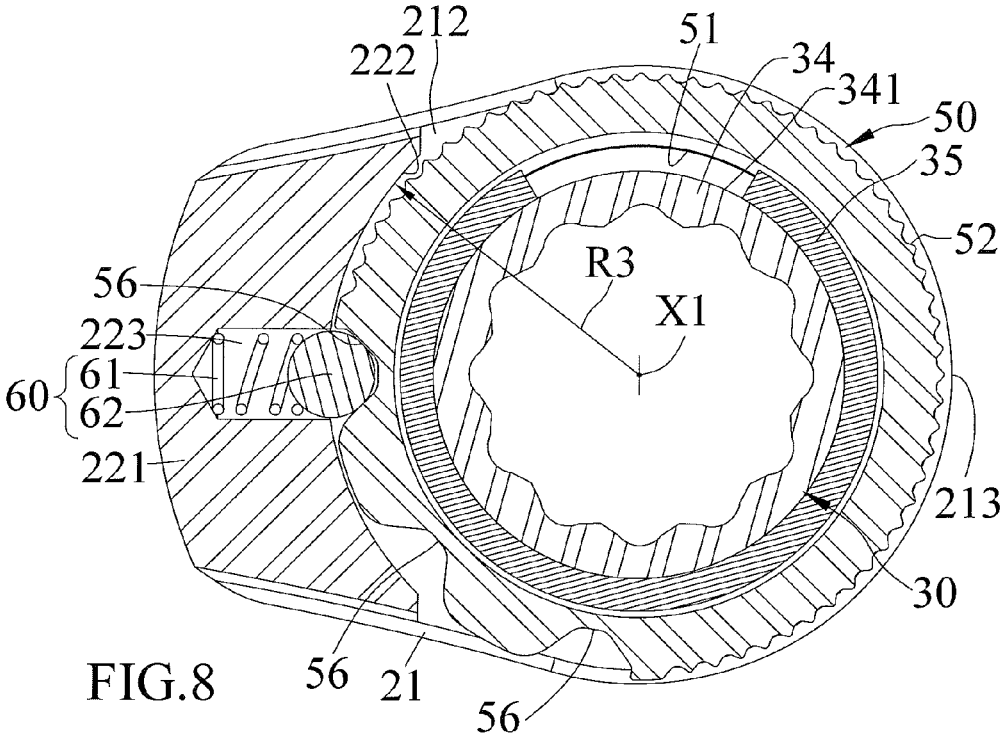
FIG. 8 shows a view similar to FIG. 7, with the ring rotated and with a positioning device engaged with a positioning portion of the switch.
Figure 7:
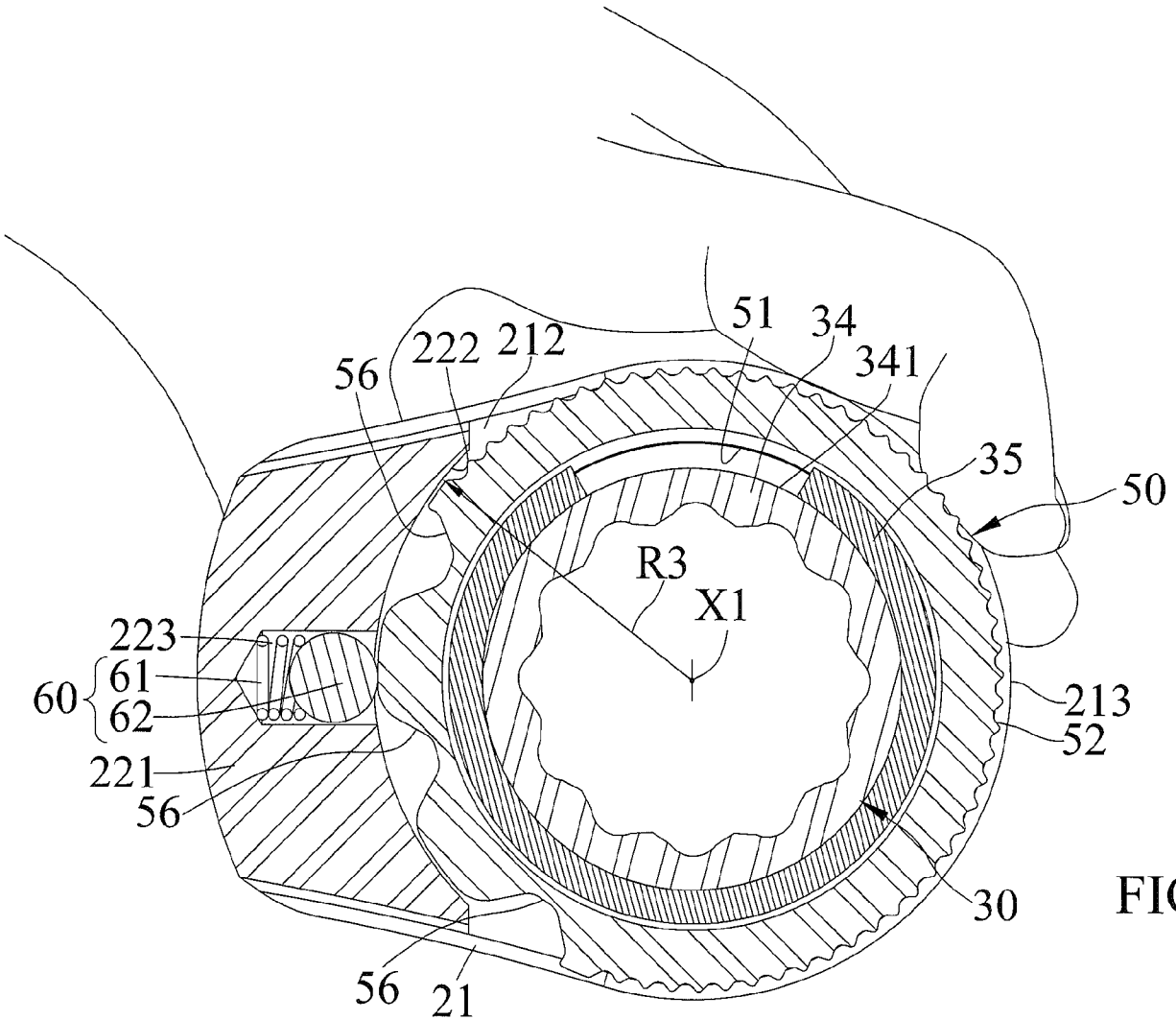
FIG. 7 shows a view similar to FIG. 5, illustrating manual rotation of a ring of a switch.

With reference to FIGS. 7 and 8, since the outer periphery of ring 52 is aligned with outer periphery 213 of head 21, the user can easily rotate ring 52 from outside to change the rotating relation between drive member 30 and head 21. Furthermore, since the radius of ring 52 is smaller than first radius R1 of outer periphery 213 of head 21, ring 52 remains in first radius R1 of outer periphery 213 of head 21 while switch 50 rotates relative to head 21. Thus, switch 50 does not extend beyond first radius R1, allowing connecting section 22 to be closer to rotating axis X1 without being interfered by switch 50, effectively reducing the radial dimension of head 21 and achieving reduction of the size of head 21.

After switch 50 is rotated, positioning device 60 can be retained in one of first, second, and third positioning portions 56 to retain switch 50 in the desired location. Since positioning device 60 is mounted to vertical connecting portion 221 integrally connected to first side 211 of head 21, extension 214 of head 21 can be very short as long as the radial extent of extension 214 allows connecting section 22 to be close to drive member 30. Since vertical connecting portion 221 of connecting section 22 is close to first, second, and third positioning portions 56 of switch 50, the radial dimension of head 21 can be effectively reduced to reduce the size of head 21.

Figure 9:
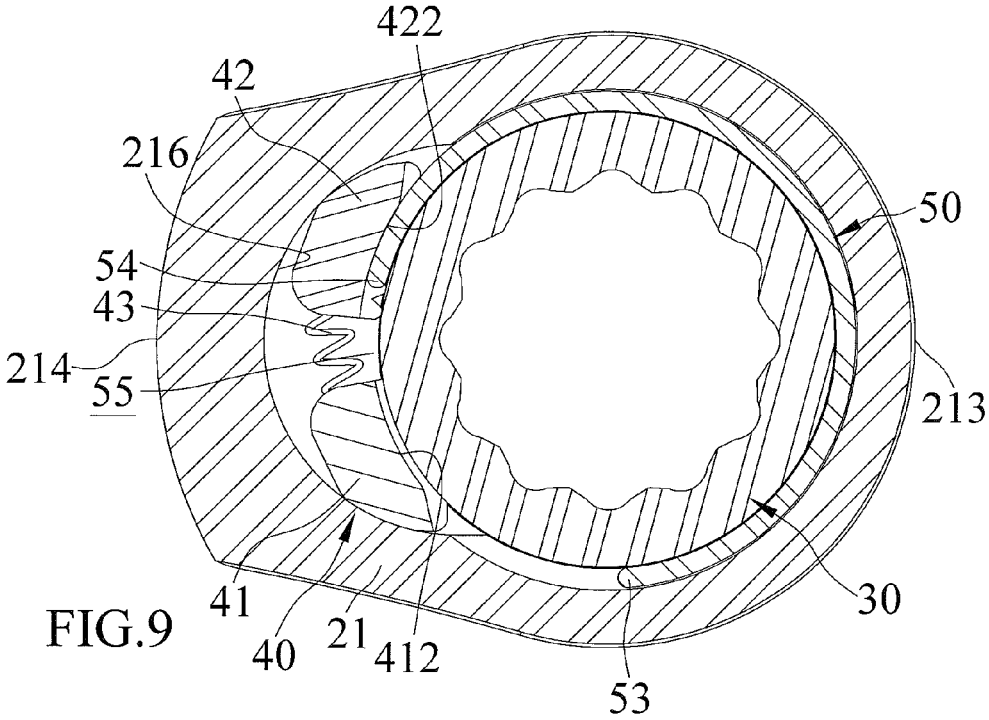
FIG. 9 shows a view similar to FIG. 6, illustrating actuation of a second pawl by a second actuating portion of the switch.
Figure 10:
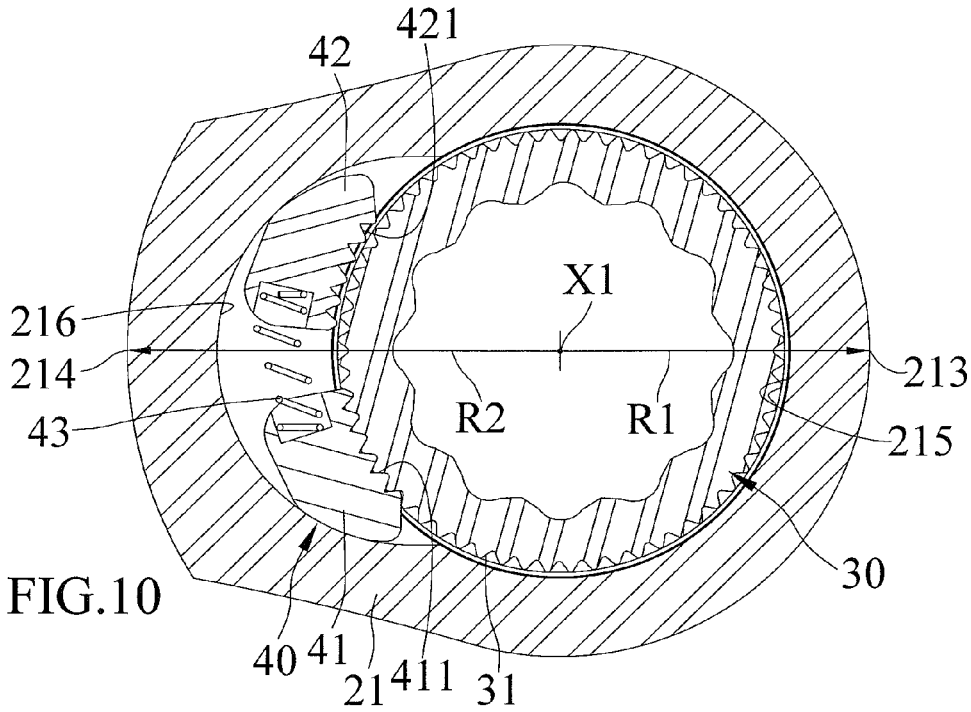
FIG. 10 shows a view similar to FIG. 4, with the second pawl disengaged from a drive member.

With reference to FIGS. 9 and 10, after switch 50 is positioned, second actuating portion 54 of switch 50 can push second push face 422 of second pawl 42 to disengage second pawl 42 from drive member 30. Since the thickness of second actuating portion 54 is larger than the height of second toothed section 421 of second pawl 42, second pawl 42 disengages from drive member 30 when second actuating portion 54 separates second pawl 42 from drive member 30. Note that second pawl 42 presses against the other lateral wall of second compartment 216 under the bias of elastic element 43. Thus, first and second pawls 41 and 42 provide reliable ratcheting effect. In the state shown in FIG. 10, drive member 30 can rotate in a clockwise direction relative to head 21.

Figure 11:
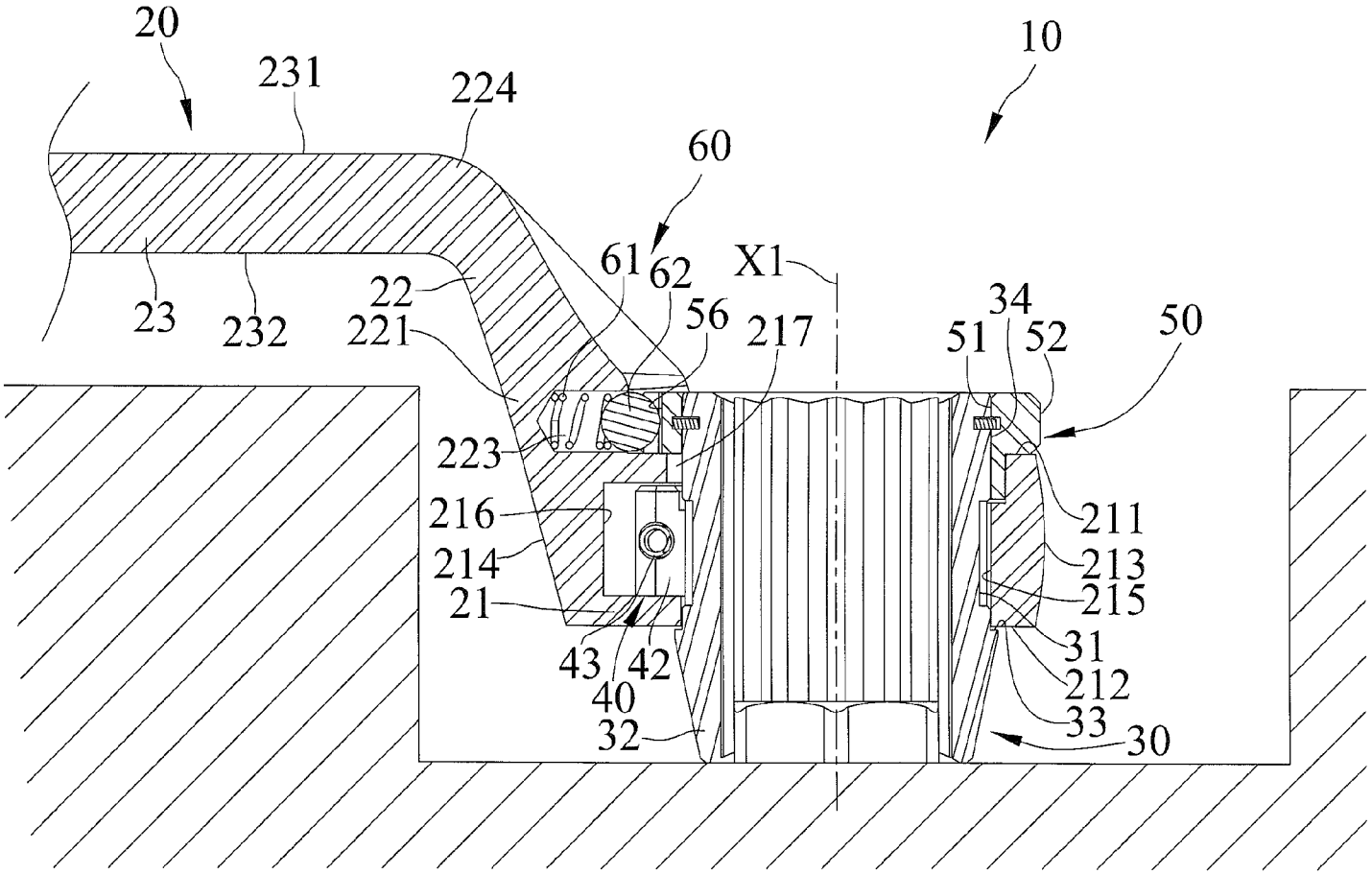
FIG. 11 shows a cross sectional view illustrating use of the ratchet wrench in a small space.

With reference to FIG. 11, compared to conventional ratchet wrenches, the radial dimension of head 21 is relatively small. Thus, ratchet wrench 10 can extend into smaller spaces for driving the workpieces in the smaller spaces to rotate, significantly eliminating hindrance by obstacles in the smaller spaces.

Figure 12:
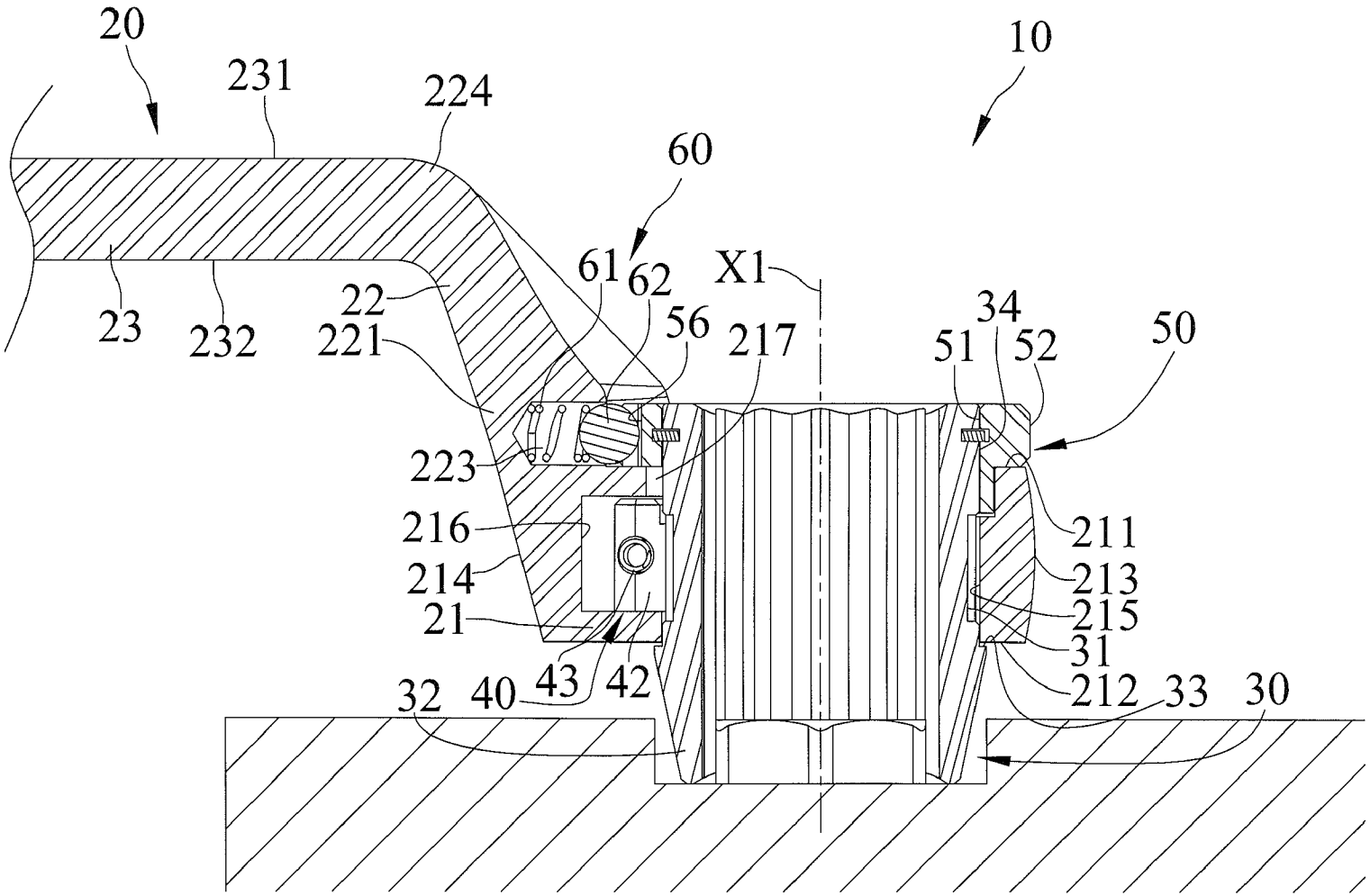
FIG. 12 shows a cross sectional view illustrating use of the ratchet wrench in a countersink.

With reference to FIG. 12, since driving portion 32 extends beyond second side 212 of head 21 and includes a polygonal hole and a conical outer periphery, the ratchet wrench 10 is suitable to work in a countersink without an extension rod or extension socket, which is convenient to the user.

Figure 13:
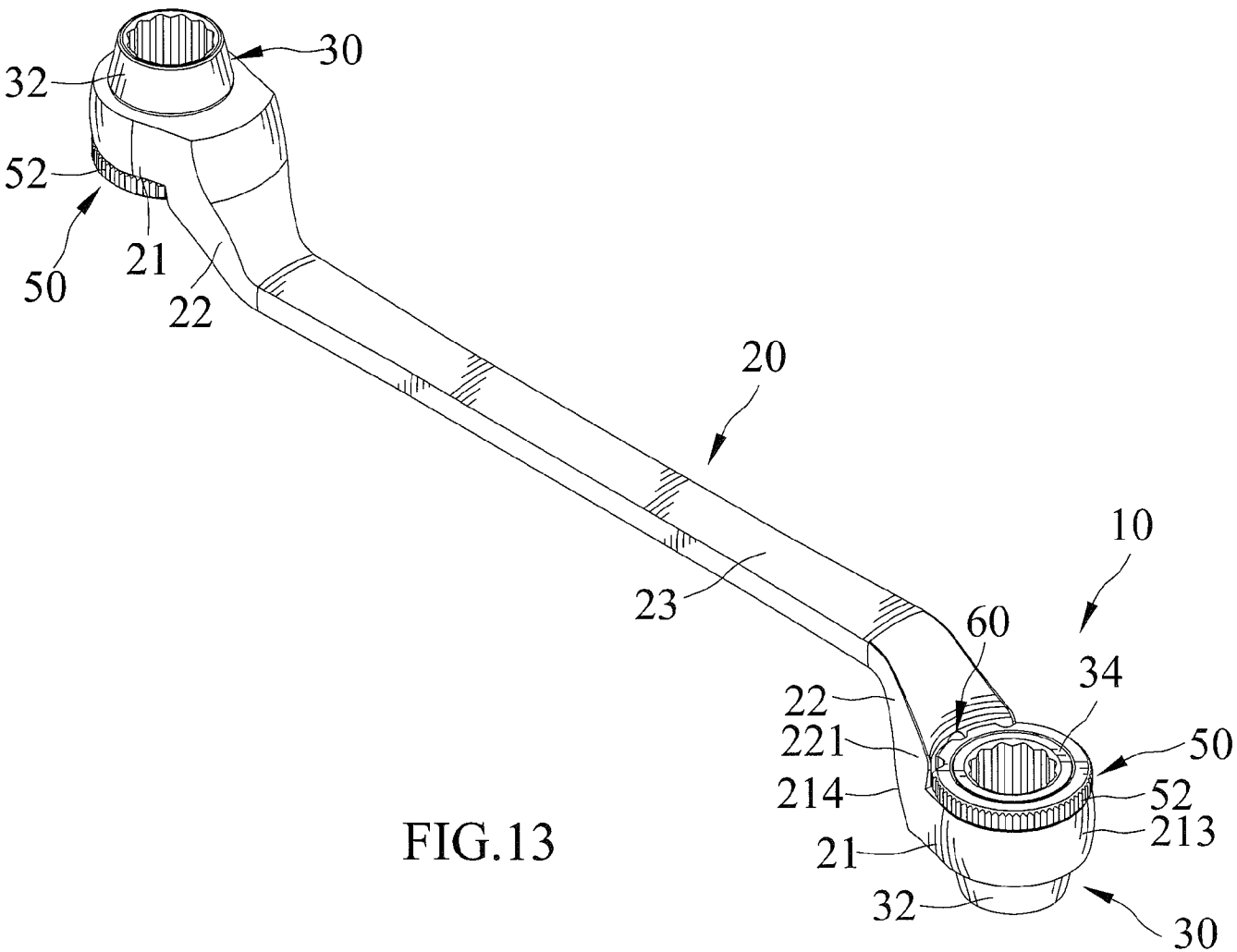
FIG. 13 shows a perspective view of a ratchet wrench of a second embodiment according to the present invention.

FIG. 13 shows ratchet wrench 10 of a second embodiment. The difference between the first and second embodiments is that an inclined connecting portion and a head 21 are provided on each of two ends of handle 23. Driving members 30 in heads 21 are of different sizes for driving workpieces of different sizes.

Figure 14:
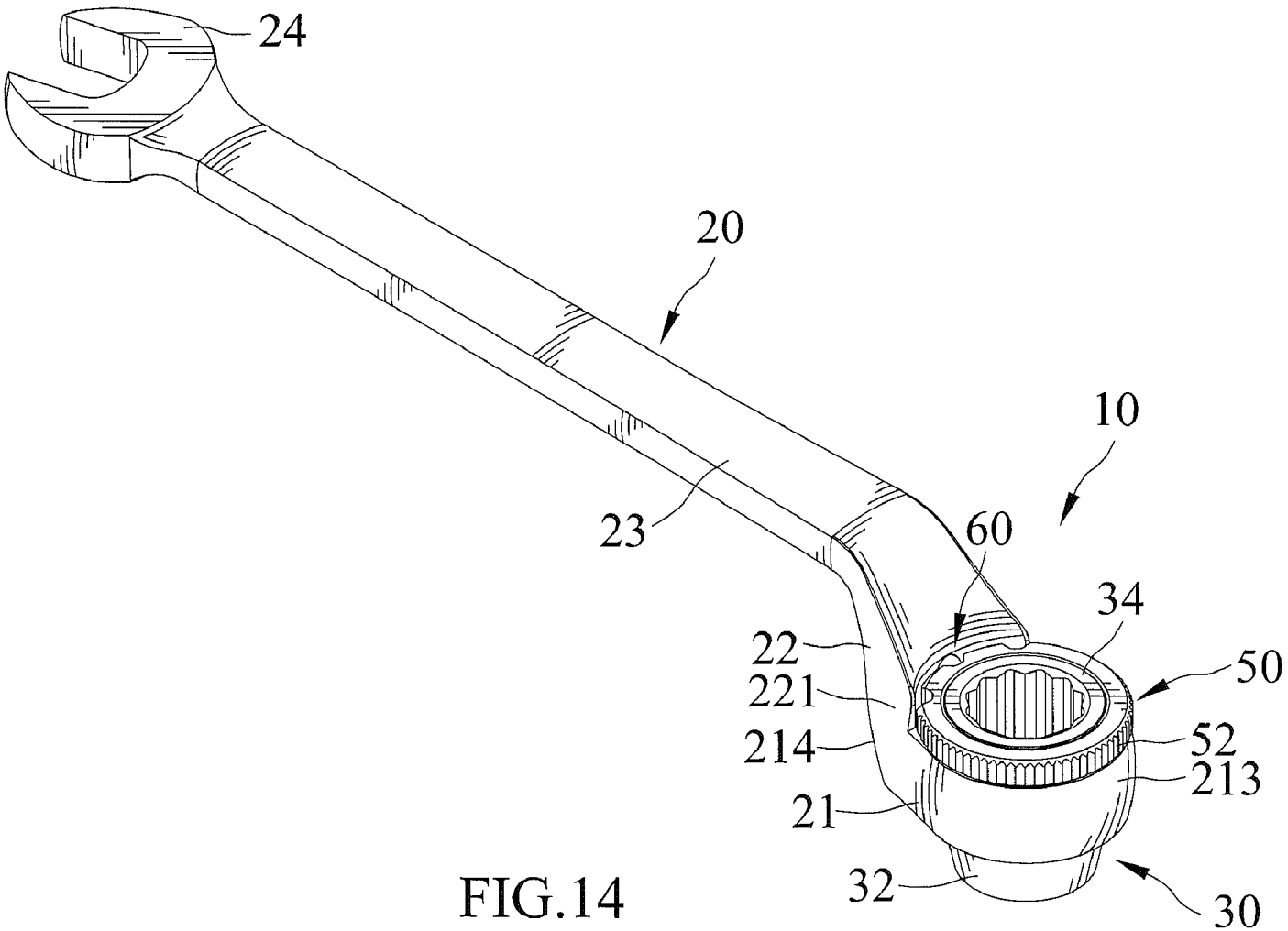
FIG. 14 shows a perspective view of a ratchet wrench of a third embodiment according to the present invention.

FIG. 14 shows ratchet wrench 10 of a third embodiment substantially the same as the first embodiment except that the other end of handle 23 of the third embodiment has an open end 24.

Figure 15:
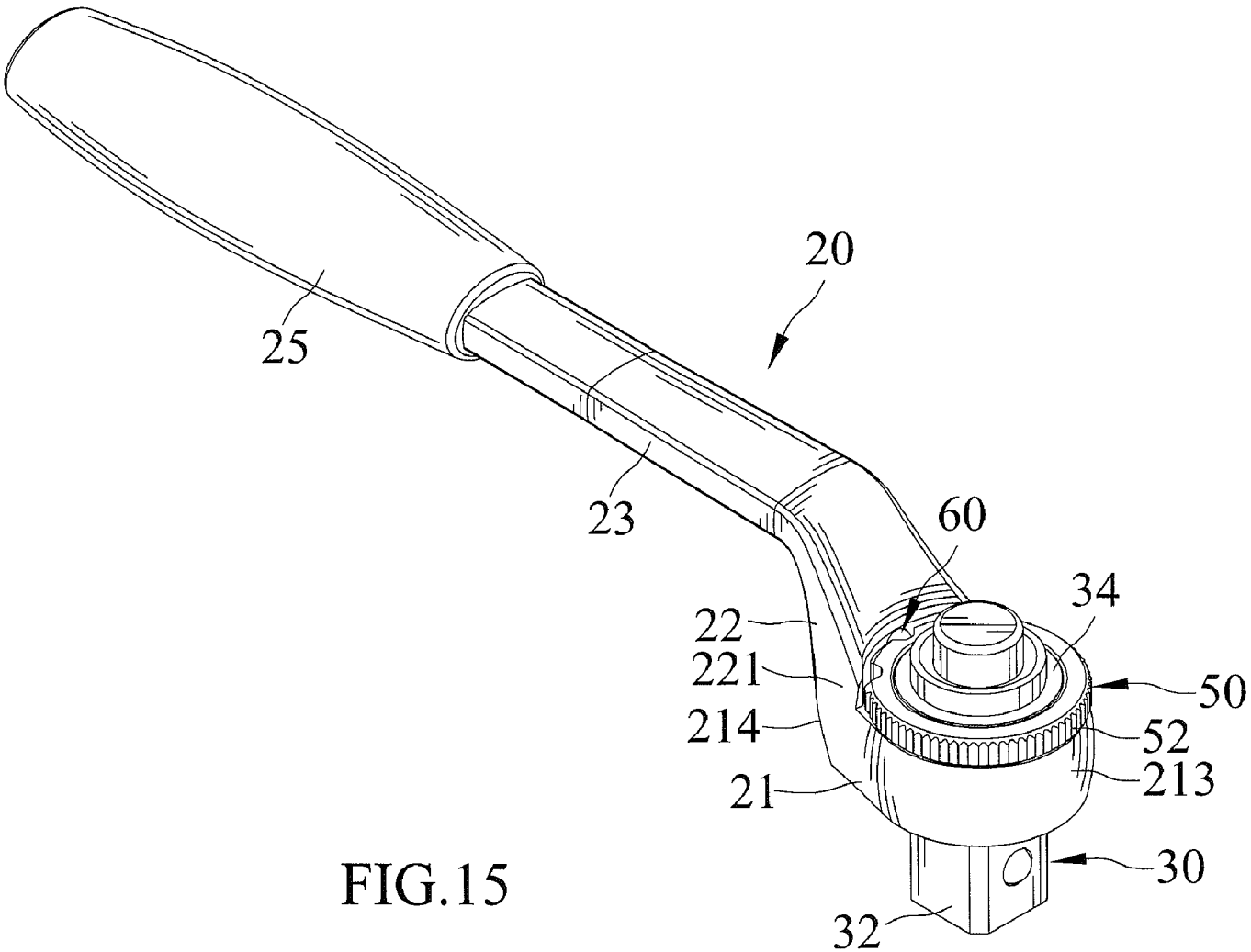
FIG. 15 shows a perspective view of a ratchet wrench of a fourth embodiment according to the present invention.

FIG. 15 shows ratchet wrench 10 of a fourth embodiment substantially the same as the first embodiment except that the other end of handle 23 of the fourth embodiment has a grip 25 and that driving portion 32 of drive member 30 is in the form of a drive column having square cross sections.

Figure 16:
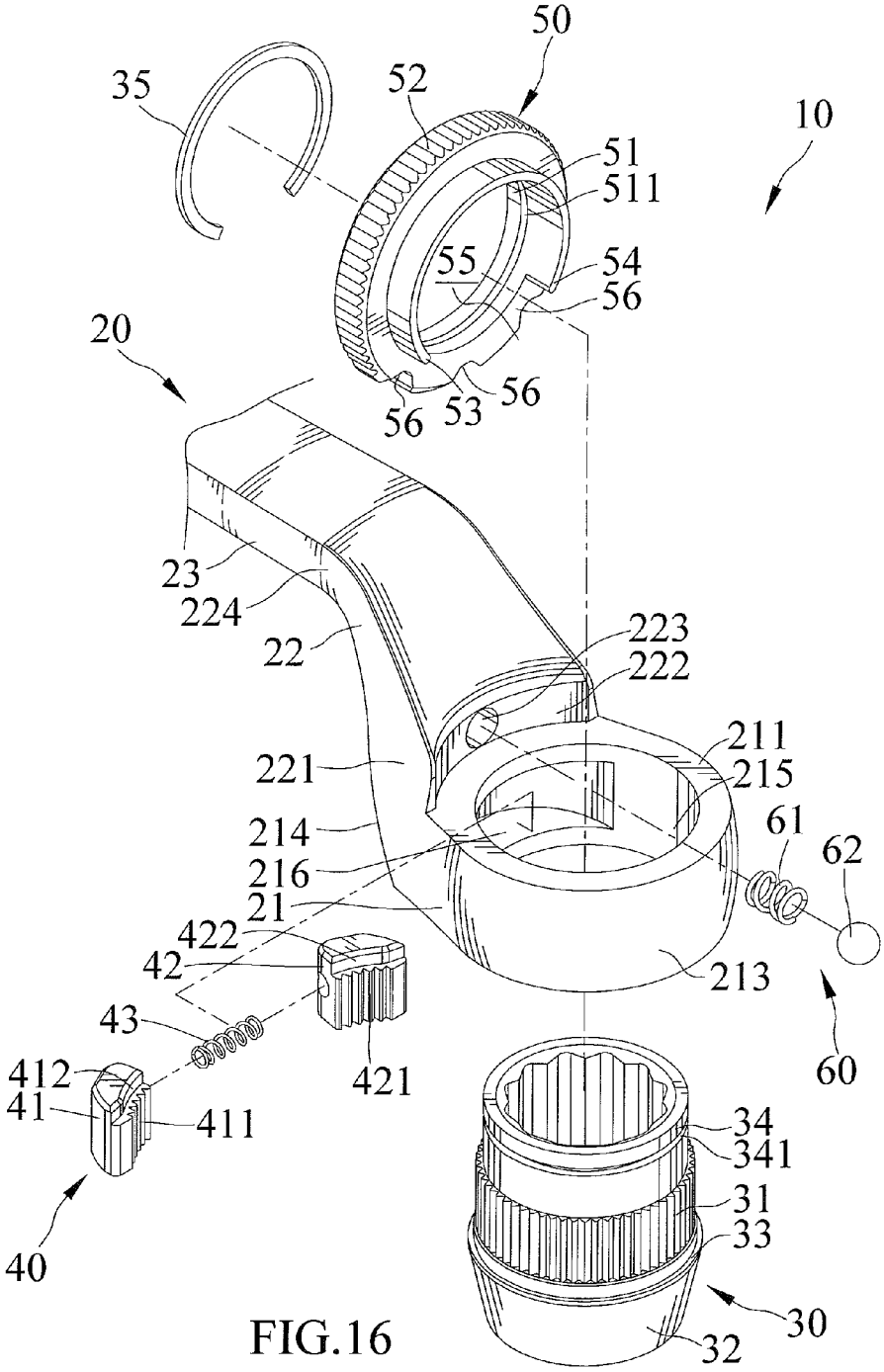
FIG. 16 shows a partial, exploded, perspective view of a ratchet wrench of a fifth embodiment according to the present invention.
Figure 17:
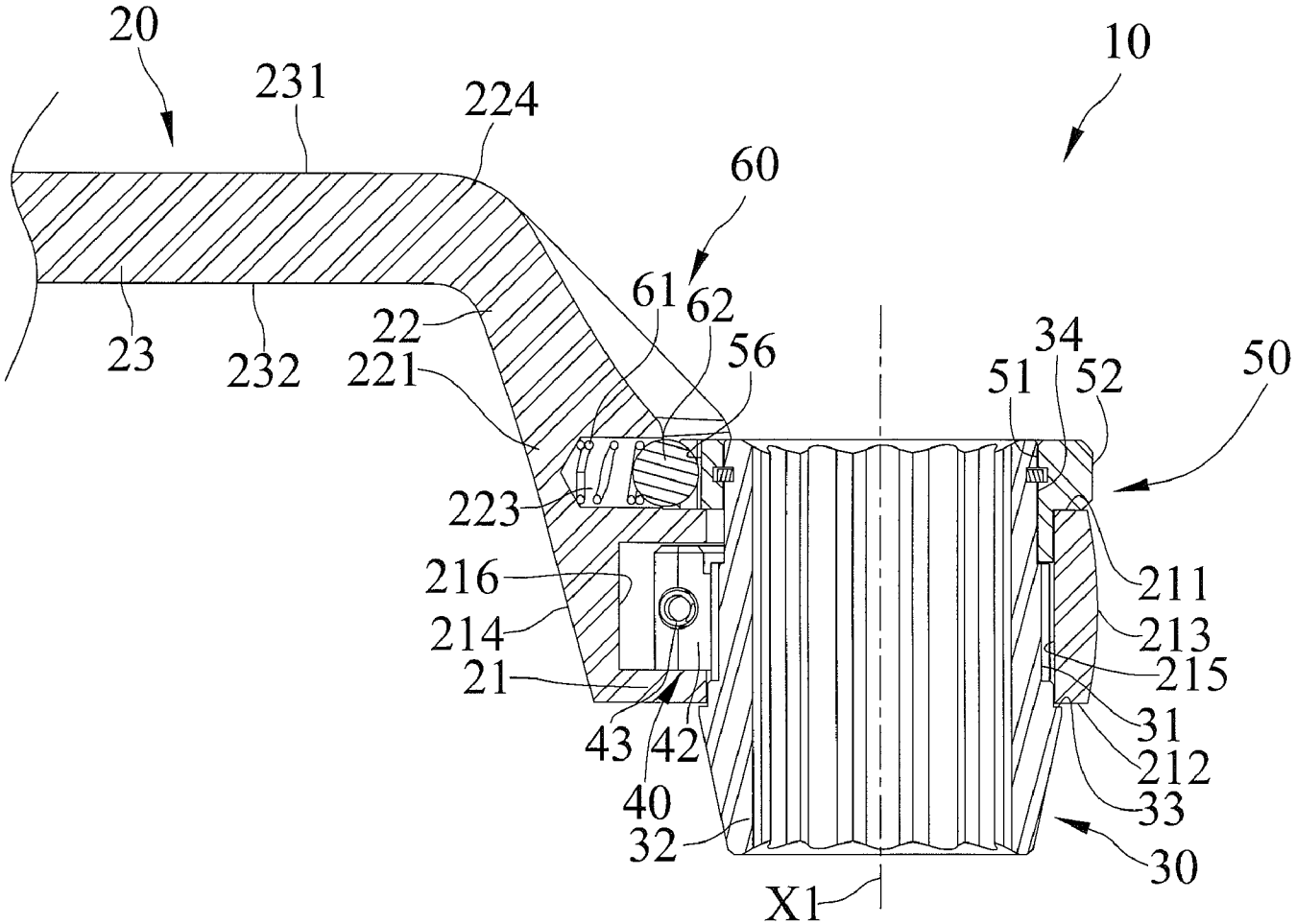
FIG. 17 shows a partial, perspective view of the ratchet wrench of FIG. 16.

FIGS. 16 and 17 show ratchet wrench 10 of a fifth embodiment substantially the same as the first embodiment except that the diameter of axle 34 of drive member 30 of the fifth embodiment is smaller than the diameter of first compartment 215, such that first and second actuating portions 53 and 54 of switch 50 directly extend through first compartment 215 into second compartment 216 for controlling the engagement relations between pawl device 40 and drive member 30, further reducing the size of head 21 by reducing the radial dimension of head 21.

Figure 18:
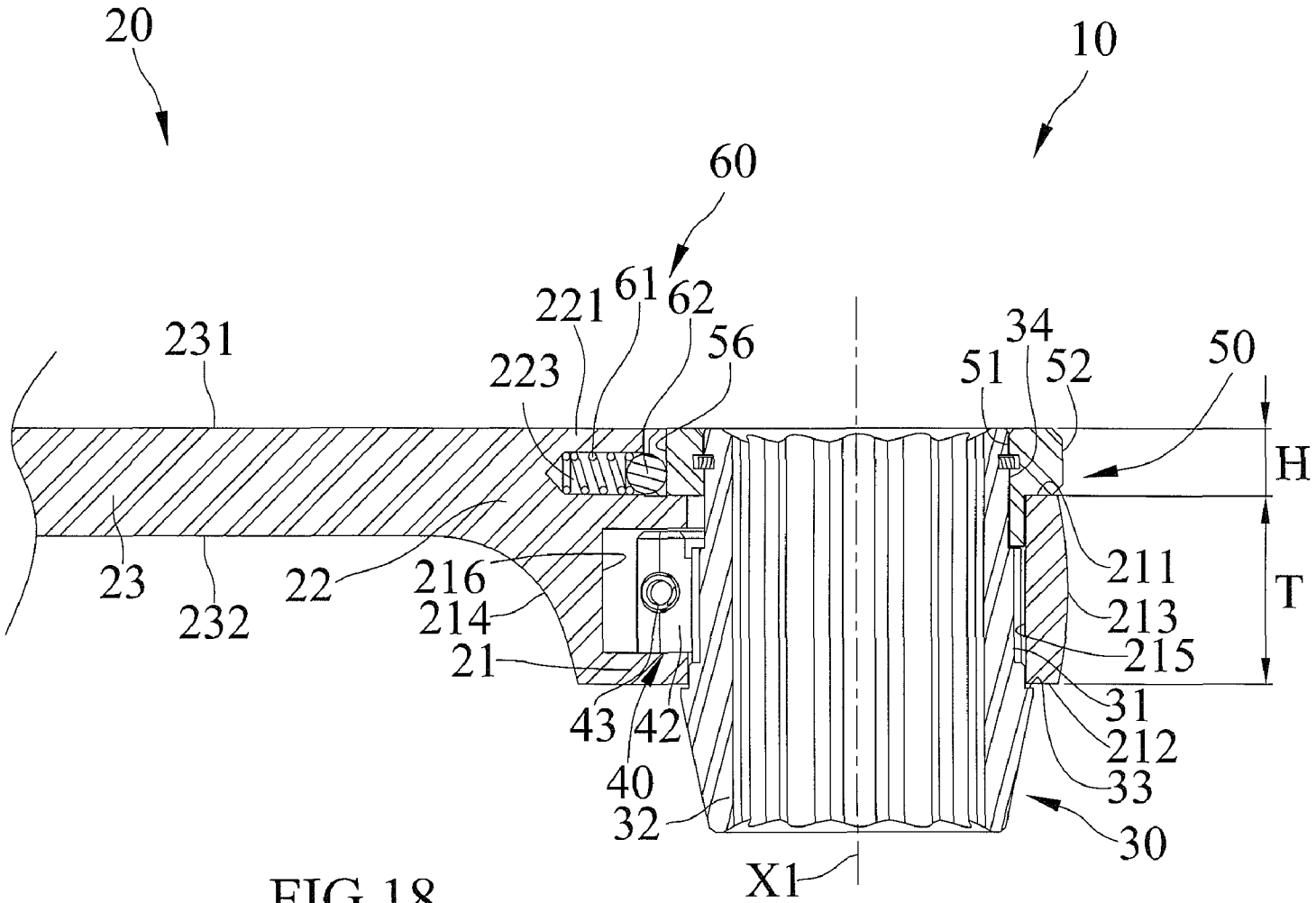
FIG. 18 shows a partial, cross sectional view of a ratchet wrench of a sixth embodiment according to the present invention.

FIG. 18 shows ratchet wrench 10 of a sixth embodiment substantially the same as the first embodiment except that a spacing between lower face 232 of handle 23 and second side 212 of head 21 is larger than half of thickness T of head 21 in the sixth embodiment. Furthermore, the spacing between upper face 231 of handle 23 and first side 211 of head 21 is larger than height H of vertical connecting portion 221 and smaller than thickness T of head 21. This allows the small head 21 to extend into smaller spaces for operation while reducing the radial dimension of head 21. Preferably, the spacing between upper face 231 of handle 23 and first side 211 of head 21 is equal to height H of vertical connecting portion 221.

The exposed extent of ring 52 outside of first side 211 of head 21 is equal to height H of vertical connecting portion 221 along rotating axis X1. Preferably, the spacing between upper face 231 of handle 23 and first side 211 of head 21 is equal to height H of vertical connecting portion 221. Furthermore, the exposed extent of ring 52 outside of first side 211 of head 21 is equal to the protruding extent of axle 34 beyond first side 211 of head 21. The top face of ring 52 is flush with the top face of axle 34. Thus, the top face of axle 34 is exposed and accessible to the user.

If desired, switch 50 can include only first and second positioning portions 56, such that pawl device 40 can be selectively engageable with drive member 30 in either of first and second engagement relations corresponding to two driving directions of ratchet wrench 10 driving the workpiece.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising:

a body including a head, a handle, and a connecting section between the head and the handle, with the head defining a rotating axis, with the head adapted to drive a workpiece to rotate, with the head including first and second sides spaced along the rotating axis, with the first side having a spacing to the workpiece larger than the second side, with the head further including an outer periphery extending between the first and second sides and surrounding the rotating axis, with the outer periphery including an arcuate section, with an extension extending outward from a section of the outer periphery outside of the arcuate section in a radial direction perpendicular to the rotating axis, with the head further including a first compartment extending from the first side through the second side of the head along the rotating axis, with the first compartment having circular cross sections and including an inner periphery, with a second compartment formed in a portion of the inner periphery of the first compartment aligned with the extension, with the second compartment extending towards the extension, with the connecting section including a vertical connecting portion at an end thereof, with the vertical connecting portion integrally connected to the first side of the head, with another end of the connecting section integrally connected to an end of the handle;

a drive member rotatably received in the first compartment of the head, with the drive member rotatable relative to the head about the rotating axis;

a pawl device mounted in the second compartment of the body, with the pawl device selectively engageable with the drive member in either of first and second engagement relations corresponding to two driving directions of the ratchet wrench driving the workpiece;

a switch pivotably mounted to the drive member and operatively connected to the pawl device in the second compartment, with the switch including a ring exposed outside of the first side of the head for manual operation to control the pawl device to be in one of the first and second engagement relations with the drive member; and a positioning device mounted between the switch and the vertical connecting portion of the connecting section, with the ring including first and second positioning portions, with the positioning device engaged with one of the first and second positioning portions to retain the ring, maintaining the pawl device in one of the first and second engagement relations with the drive member.

2. The ratchet wrench as claimed in claim 1, with the vertical connecting portion including a receptacle extending in a radial direction perpendicular to the rotating axis, with the positioning device including an elastic element received in the receptacle and a positioning member between the elastic element and the switch, with the positioning member biased by the elastic element to engage with one of the first and second positioning portions.

3. The ratchet wrench as claimed in claim 1, with the drive member including first and second ends spaced along the rotating axis, with an axle formed on the first end of the drive member, with the switch including an axle hole, with the axle received in the axle hole, with the switch and the drive member pivotable relative to each other.

4. The ratchet wrench as claimed in claim 3, with the axle extending beyond the first side of the head, with the axle including an annular engagement groove, with the axle hole of the switch including an inner periphery having an annular engagement groove, with a retainer ring engaged in the engagement grooves of the axle and the switch, preventing disengagement of the switch while allowing relative rotating movement between the switch and the drive member, with the drive member including a stepped portion on an outer periphery thereof, with the stepped portion having an outer diameter larger than a diameter of the first compartment.

5. The ratchet wrench as claimed in claim 4, with the drive member including an annular toothed portion between the first and second ends of the drive member, with the toothed portion of the drive member received in the first compartment of the body, with the pawl device including first and second pawls and an elastic element mounted between the first and second pawls, with the elastic element biasing the first and second pawls to press against two lateral walls of the second compartment, with the first pawl including a first toothed section facing the first compartment, with the first toothed section engageable with the toothed portion of the drive member under bias of the elastic element, with the second pawl including a second toothed section facing the first compartment, with the second toothed section engageable with the toothed portion of the drive member under the bias of the elastic element.

6. The ratchet wrench as claimed in claim 5, with the first pawl including a first push face, with the second pawl including a second push face, with the switch including first and second actuating portions extending into the second compartment, with the switch pivotable in a first direction to cause the first actuating portion to press against the first push face, disengaging the first toothed section from the toothed portion of the drive member, with the switch pivotable in a second direction opposite to the first direction to cause the second actuating portion to press against the second push face, disengaging the second toothed section from the toothed portion of the drive member.

7. The ratchet wrench as claimed in claim 6, with the ring including a lip extending perpendicularly from an inner face of the ring, with the lip including the first and second actuating portions, with a notch formed between the first and second actuating portions.

8. The ratchet wrench as claimed in claim 7, with the ring further including a third positioning portion between the first and second portions, with the first and second toothed sections of the first and second pawls engaged with toothed portion of the drive member and with the positioning device engaged with the third positioning portion when the first and second pawls are located in the notch, preventing the drive member from rotating relative to the head.

9. The ratchet wrench as claimed in claim 7, with the axle of the drive member having an outer diameter smaller than a diameter of the first compartment, with the first and second actuating portions of the switch extending through the first compartment into the second compartment.

10. The ratchet wrench as claimed in claim 7, with the head further including a control groove extending from the first side through the second compartment, with the first and second actuating portions of the switch extending through the control groove into the second compartment.

11. The ratchet wrench as claimed in claim 10, with the control groove being in communication with the first compartment, with the control groove having a longitudinal axis coincident to the rotating axis, with the control groove being annular and extending between the first side of the head and the first compartment and forming a ledge, with the switch being hollow, with the first and second actuating portions being arcuate and movable in the control groove in a circumferential direction about the rotating axis.

12. The ratchet wrench as claimed in claim 3, with the head including a thickness between the first and second sides along the rotating axis, with the vertical connecting portion including a height along the rotating axis smaller than the thickness of the head, with the axle of the drive member having a protruding extent beyond the first side of the head along the rotating axis, with the protruding extent not larger than the height of the vertical connecting portion, with the ring having an exposed extent outside of the first side of the head, with the exposed extent not larger than the height of the vertical connecting portion.

13. The ratchet wrench as claimed in claim 12, with the exposed extent of the ring equal to the protruding extent of the axle.

14. The ratchet wrench as claimed in claim 13, with the exposed extent of the ring equal to the height of the vertical connecting portion.

15. The ratchet wrench as claimed in claim 12, with the handle including upper and lower faces, with the upper face having a spacing to the workpiece larger than the lower face, with a first spacing between the lower face of the handle and the second side of the head larger than half of the thickness of the head, with a second spacing between the upper face of the handle and the first side of the head larger than the height of the vertical connecting portion and smaller than the thickness of the head.

16. The ratchet wrench as claimed in claim 15, with the second spacing between the upper face of the handle and the first side of the head equal to the height of the vertical connecting portion.

17. The ratchet wrench as claimed in claim 12, with the handle including upper and lower faces, with the upper face having a spacing to the workpiece larger than the lower face, with a spacing between the lower face of the handle and the second side of the head larger than a sum of the height of the vertical connecting portion and the thickness of the head.

18. The ratchet wrench as claimed in claim 17, with the other end of the connecting section opposite to the vertical connecting portion including a bend, with the bend integrally connected to the end of the handle, with the connecting section having an inclined section intermediate the vertical connecting portion and the bend, with the inclined section having increasing widths towards the vertical connecting portion and at an angle of 75° to the handle.

19. The ratchet wrench as claimed in claim 3, with the head having a first radius from the outer periphery to the rotating axis, with the head further having a second radius from the extension to the rotating axis, with the first radius smaller than the second radius, with the vertical connecting portion including an arcuate concave face facing the rotating axis, with the arcuate concave face having a third radius to the rotating axis, with the third radius equal to the first radius.

* * * * *